US006540559B1

(12) United States Patent
Kemmick et al.

(10) Patent No.: US 6,540,559 B1
(45) Date of Patent: Apr. 1, 2003

(54) CONNECTOR WITH STAGGERED CONTACT PATTERN

(75) Inventors: Dennis L. Kemmick, Columbia, PA (US); Francis P. Morana, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/966,859

(22) Filed: Sep. 28, 2001

(51) Int. Cl.[7] ..... H01R 13/648
(52) U.S. Cl. ..... 439/608; 439/108; 439/941
(58) Field of Search ..... 439/608, 609, 439/79, 941, 101, 108

(56) References Cited

U.S. PATENT DOCUMENTS

| | | | | | |
|---|---|---|---|---|---|
| 5,114,355 | A | * | 5/1992 | Kimmel et al. | 439/101 |
| 5,743,765 | A | * | 4/1998 | Andrews et al. | 439/608 |
| 5,775,947 | A | * | 7/1998 | Suzuki et al. | 439/608 |
| 5,842,872 | A | * | 12/1998 | Hosler et al. | 439/63 |
| 6,116,926 | A | * | 9/2000 | Ortega et al. | 439/108 |
| 6,149,444 | A | * | 11/2000 | Shi et al. | 439/95 |
| 6,183,294 | B1 | * | 2/2001 | Fan et al. | 439/567 |
| 6,210,218 | B1 | * | 4/2001 | Chang | 439/567 |
| 6,350,134 | B1 | | 2/2002 | Fogg et al. | 439/79 |
| 6,375,506 | B1 | * | 4/2002 | Saunders et al. | 439/607 |

FOREIGN PATENT DOCUMENTS

JP 07161414 * 6/1995 ..... H01R/13/658

* cited by examiner

*Primary Examiner*—Lynn Field
*Assistant Examiner*—Hae Moon Hyeon

(57) ABSTRACT

A docking connector system has been provided that includes a plurality of interchangeable plug and header chicklets, or terminal modules. Each interchangeable plug and header chicklet includes a plurality of signal contact pairs with corresponding signal pins and a plurality of ground contacts with corresponding ground pins. The signal contact pairs are arranged in a pattern in which a ground contact is positioned between any two signal contact pairs in the same row. Further, a ground contact is positioned between any two signal contact pairs in the same column. The signal contact pairs in one row of the pattern are staggered relative to the signal contact pairs in an adjacent row of the pattern. That is, signal pairs in adjacent rows do not line up with each other. Each plug and header chicklet also includes a plurality of signal pins and a plurality of ground pins. Each signal pin is attached to a signal contact pair, while each ground pin is attached to a ground contact. The interchangeable plug and header chicklets may be positioned in a plug assembly or a header assembly, respectively. The plug assembly and the header assembly mate together such that electrical elements, including the signal contact pairs and ground contacts, of the plug assembly, interface, or contact, electrical elements of the header assembly.

23 Claims, 12 Drawing Sheets

CONNECTOR WITH STAGGERED CONTACT PATTERN

BACKGROUND OF THE INVENTION

Embodiments of the present invention relate to a high speed docking connector, and more particularly to a high speed docking connector having interchangeable chicklets, or terminal modules, that house electrical elements arranged in a pattern that minimizes cross-talk and electrical interference within the docking connector.

Many electronic systems, such as computers, include docking connectors. For example, a docking connector is used to connect a computer monitor to a hard drive of the computer. Typically, a docking connector includes a plug assembly and a header assembly. The plug assembly may be located, for example, on the hard drive of the computer, while the header assembly may extend from the monitor via wiring. The plug assembly and the header assembly are mated in order to provide an electrical connection between components of a system, such as the monitor and the hard drive.

Each plug assembly and header assembly includes a plurality of signal contacts and ground contacts. Typically, the signal contacts are arranged in rows or columns and the ground contacts are arranged in rows or columns. Rows of signal contacts are separated from one another by a row of ground contacts. Columns of signal contacts are separated from one another by a column of ground contacts. Thus, whether in a row or column configuration, each signal contact is adjacent to a ground contact, which is adjacent to another signal contact.

Often, electrical interference and cross talk occur between the signal contacts within the plug and header assemblies. Because the signal columns or rows are in-line with each other, two adjacent signal contacts may electrically interfere and produce cross-talk with each other. The electrical interference and cross-talk among signal contacts reduces the speed and operating efficiency of the system.

Further, typical docking connectors include electrical elements, such as signal contacts, signal pins, ground contacts and ground pins, which are individually mounted within the plug and header assemblies. That is, each assembly typically includes one large bank of electrical elements. Thus, if one electrical element falters, a bank of new electrical elements typically replaces the bank of old electrical elements that included the faltering electrical element.

Moreover, conventional connector assemblies experience certain difficulties during manufacturing. Manufacturing the assemblies with one bank, or a set of electrical elements may cause mechanical stresses and strains within the assemblies. That is, the walls of the assembly housing may bow and buckle from the forces, stresses and strains exerted by the large bank of electrical elements included within each assembly.

Thus a need exists for a docking connector that minimizes electrical interference and cross-talk among signal contacts. Further, a need exists for a docking connector that may accommodate increased signal speeds. Also, a need exists for a docking connector having electrical elements that may be easily and efficiently replaced.

SUMMARY OF THE INVENTION

In accordance with an embodiment of the present invention, a connector system has been developed that includes a plurality of interchangeable plug and header terminal modules, or chicklets, each of said interchangeable terminal modules comprises a terminal module housing, a plurality of signal contact pairs held in the terminal module housing and arranged in rows and columns; and a plurality of ground contacts held in the terminal module housing, arranged in the rows and columns and interspersed between adjacent signal contact pairs. The ground contacts and signal contact pairs are arranged in a staggered pattern with a ground contact positioned between adjacent signal contact pairs in at least one row, and with a ground contact positioned between adjacent signal contact pairs in at least one column. Each interchangeable plug and header terminal module further comprises a plurality of signal pins and a plurality of ground pins. Each of the signal pins is attached to a signal contact of a signal contact pair, and each of the ground pins is attached to a ground contact. Each terminal module housing includes a pin housing for receiving and retaining the signal and ground pins and a contact housing for receiving and retaining the signal contact pairs and the ground contacts. The pin housing and the contact housing are snapably positioned to one another.

The connector system also includes a plug assembly and a header assembly. The plug assembly includes a plurality of terminal module ports, wherein one interchangeable plug terminal module is positioned within one terminal module port. The header assembly also includes a plurality of terminal module ports, wherein one interchangeable header terminal module is positioned within one terminal module port. The system also includes a first ground board connected to the plug assembly and a second ground board connected to the header assembly. Additionally, the system includes a first circuit board connected to the plug assembly and a second ground board connected to the header assembly.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments that are present preferred. It should be understood, however, that the present invention is not limited to the precise arrangements and instrumentality shown in the attached drawings.

DETAILED DESCRIPTION OF THE DRAWINGS

Figure 1:
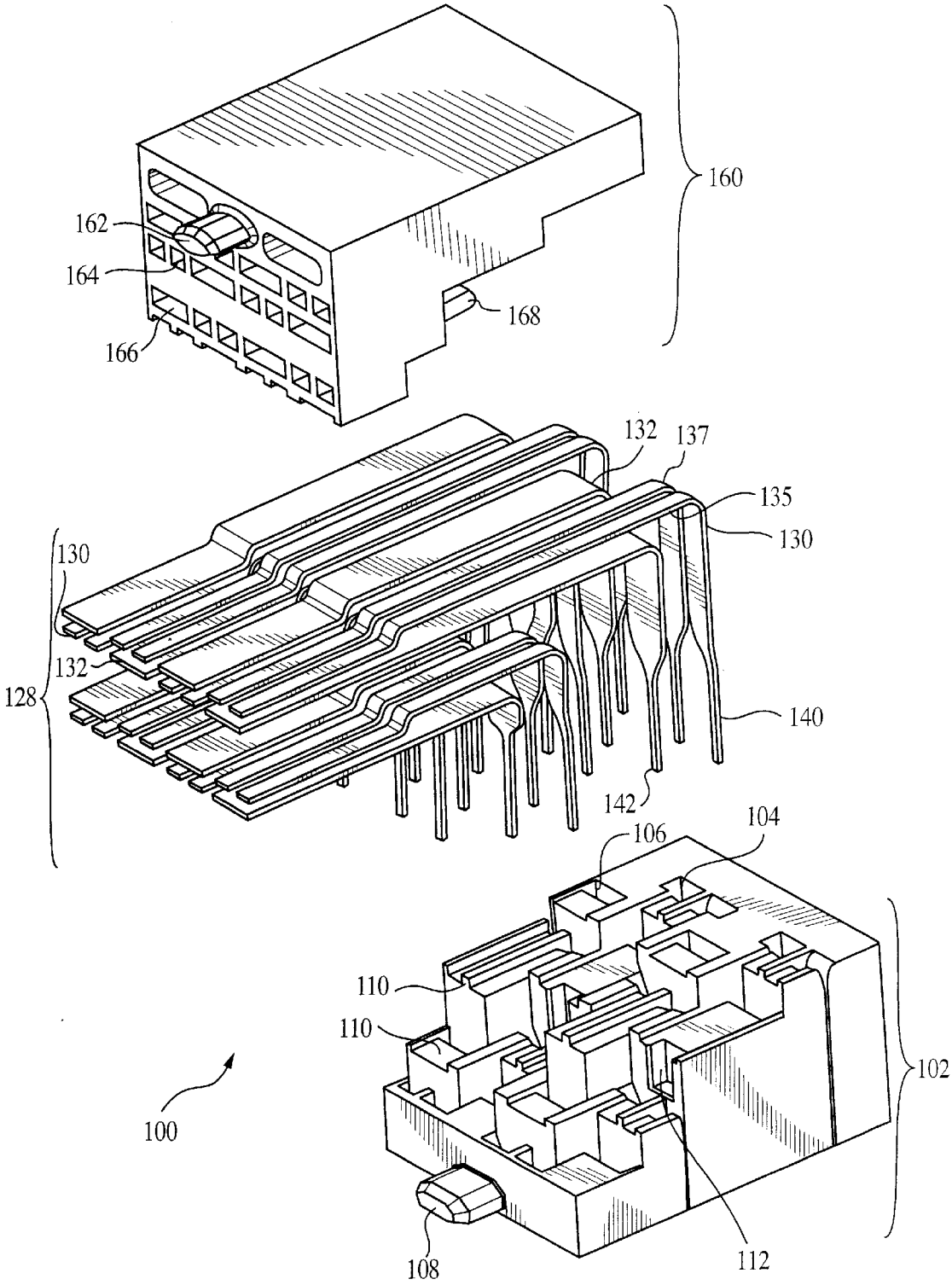
FIG. 1 is a front isometric exploded view of a plug chicklet formed in accordance with an embodiment of the present invention.
Figure 2:
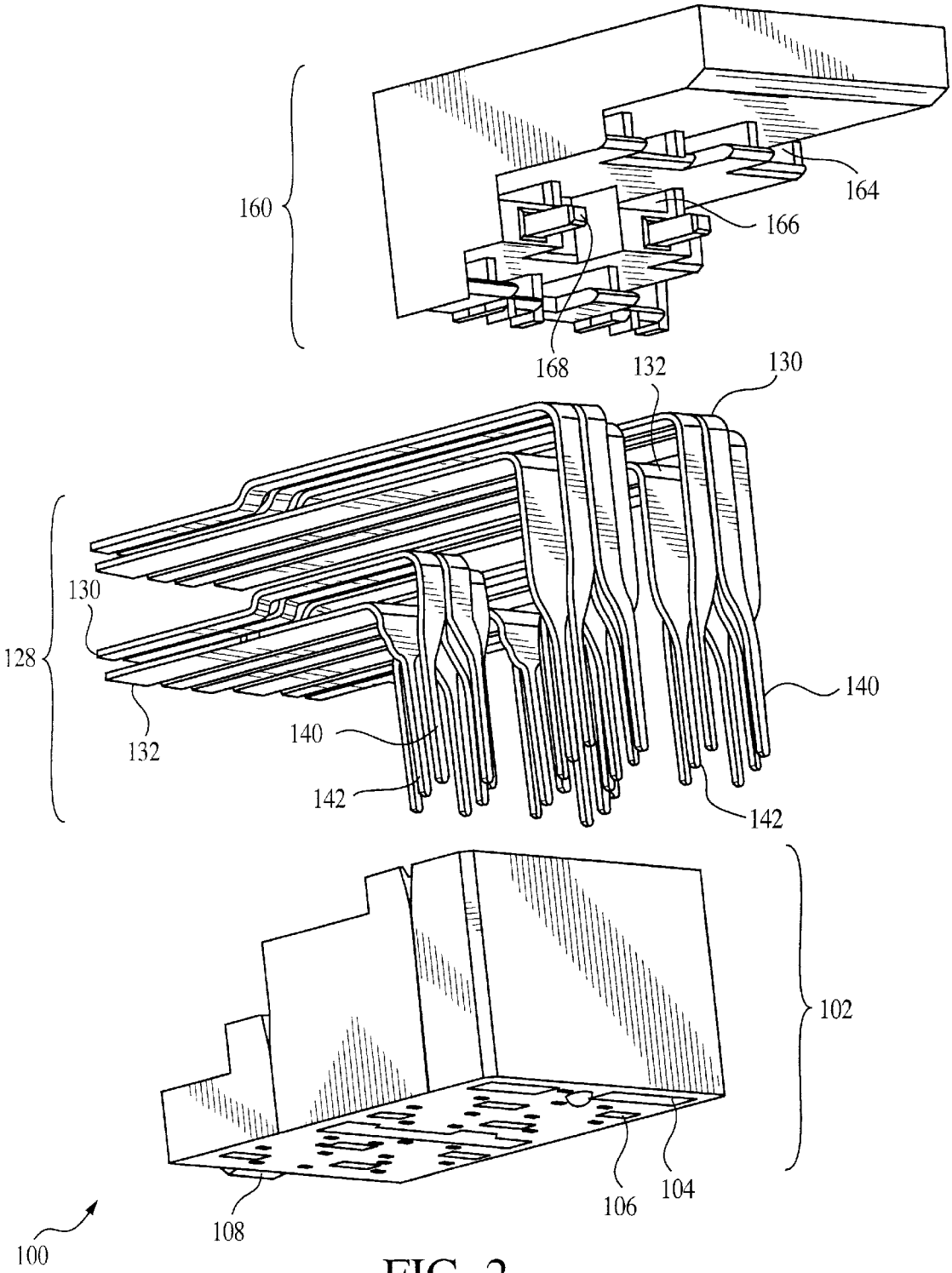
FIG. 2 is a rear isometric exploded view of a plug chicklet formed in accordance with an embodiment of the present invention.

FIG. 1 is a front isometric exploded view of a plug chicklet or plug terminal module 100 formed in accordance with an embodiment of the present invention. FIG. 2 is a rear isometric exploded view of the plug chicklet 100 formed in accordance with an embodiment of the present invention. The plug chicklet 100 includes a pin housing 102, electrical elements 128, and a contact housing 160. The pin housing 102 includes signal pin channels 104, ground pin channels 106, an alignment member 108, such as a latch or pin, aligning supports 110 and fastening receptacles 112, such as notches. The electrical elements 128 include a plurality of signal contact pairs 130 having signal contacts 135 and 137, a plurality of signal pins 140 connected to the signal contact pairs 130, a plurality of ground contacts 132 and a plurality of ground pins 142 connected to the ground contacts 132. The contact housing 160 includes an alignment member 162, such as a latch or pin, signal contact passages 164, ground contact passages 166 and fastening members 168, such as latches or pins.

Each signal contact 135 and 137 connects to a signal pin 140 and each ground contact 132 connects to a ground pin 142. Each signal contact 135, 137 and ground contact 132 is formed such that each signal contact 135, 137 and ground contact is bent into a right angle, as shown in FIG. 1. Alternatively, each signal contact 135 and 137 may be formed with, or joined to, its corresponding signal pin 140 through a right angle union, and each ground contact 132 may be formed with, or joined to, its corresponding ground pin 142 through a right angle union, thereby obviating the need to bend each signal contact 135, 137 and ground contact 132 into a right angle. That is, the signal contacts 135 and 137 are not coplanar with the signal pins 140. Similarly, the ground contacts 132 are not coplanar with the ground pins 142.

To assemble the plug chicklet 100, the signal and ground pins 140 and 142 are positioned within the signal pin channels 104 and the ground pin channels 106, respectively. That is, the signal pin channels 104 and the ground pin channels 106 receive and retain the signal pins 140 and the ground pins 142, respectively. Once the signal and ground pins 140 and 142 are received and retained by the channels 104 and 106, the aligning supports 110 support and align the signal contact pairs 130 and the ground contacts 132. After the signal and ground pins 140 and 142 are positioned within the pin housing 102, the contact housing 160 is slid into position such that the signal contact pairs 130 and ground contacts 132 are received by the signal contact passages 164 and the ground contact passages 166. That is, the signal contact passages 164 and ground contact passages 166 receive and retain the signal contact pairs 130 and ground contacts 132, respectively. The contact housing 160 is slid toward the pin housing 102 until the fastening members 168 are received by the fastening receptacles 112. Preferably, the fastening members 168 snapably engage the fastening receptacles 112 thereby fastening the pin housing 102 to the contact housing 160. Thus, the electrical elements 128 are securely positioned within the pin housing 102 and the contact housing 160.

Figure 3:
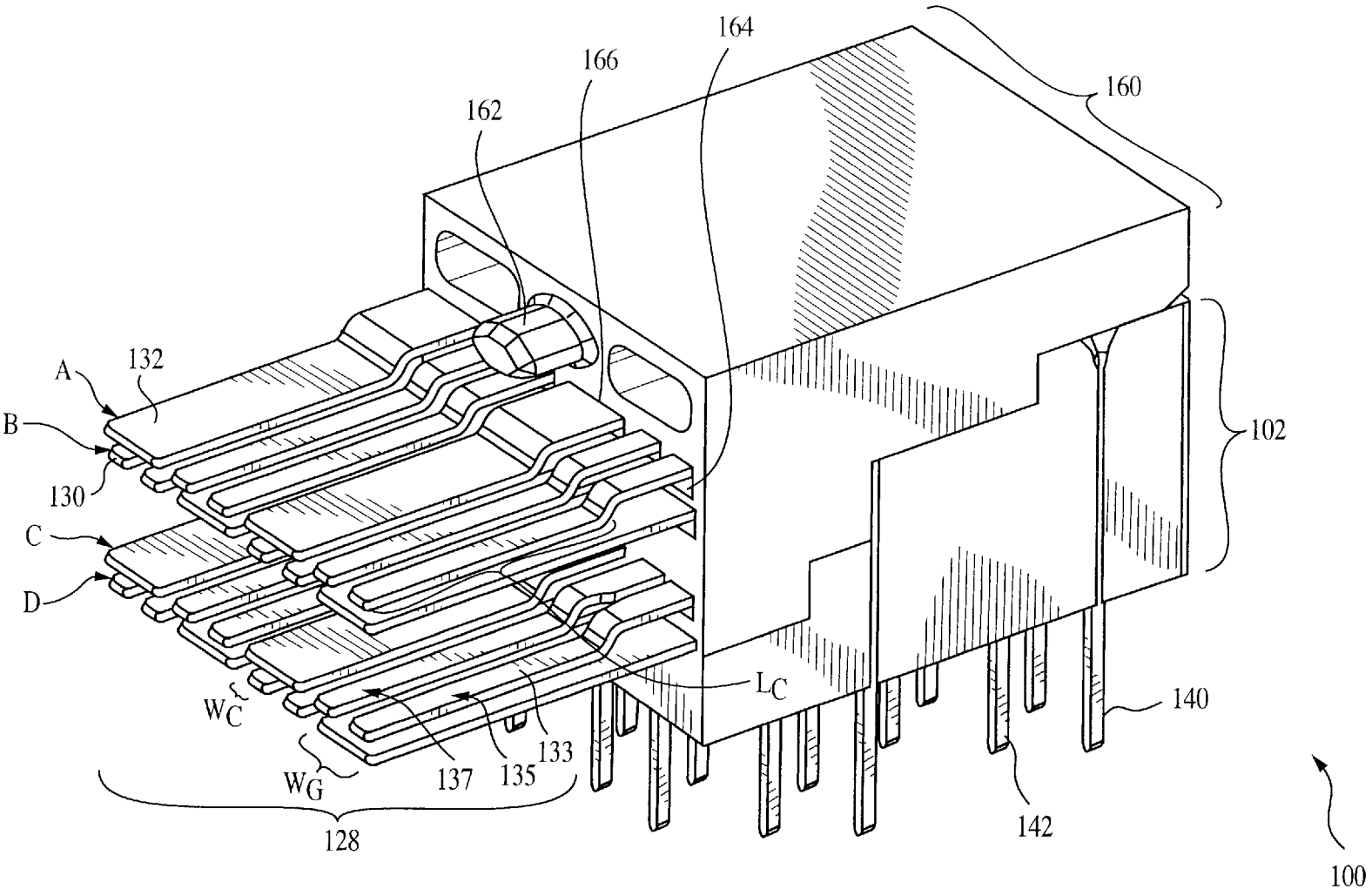
FIG. 3 is an isometric view of an assembled plug chicklet formed in accordance with an embodiment of the present invention.

FIG. 3 is an isometric view of an assembled chicklet 100 formed in accordance with an embodiment of the present invention. The signal contact pairs 130 each include two signal contacts 135 and 137 having planar blade-shaped, body sections 133 arranged directly adjacent one another. The planar body sections 133 of a signal contact pair 130 have a length $L_C$ and a width $W_C$, and are aligned in a common plane. The electrical elements 128 of the chicklet 100 are configured such that no signal contact pair 130 is horizontally or vertically directly adjacent to another signal contact pair 130. That is, two signal contact pairs 130 positioned within the same row are separated by a ground contact 132. Further, two signal contact pairs 130 positioned within the same column are separated by a ground contact 132. Each ground contact 132 has a width $W_G$, while each signal contact in a signal contact pair 130 has a width $W_C$. Each ground contact 132 is approximately the same width $W_G$ as a signal contact pair 130 ($2W_C$ plus the space between signal contacts in a signal contact pair 130).

Figure 8:
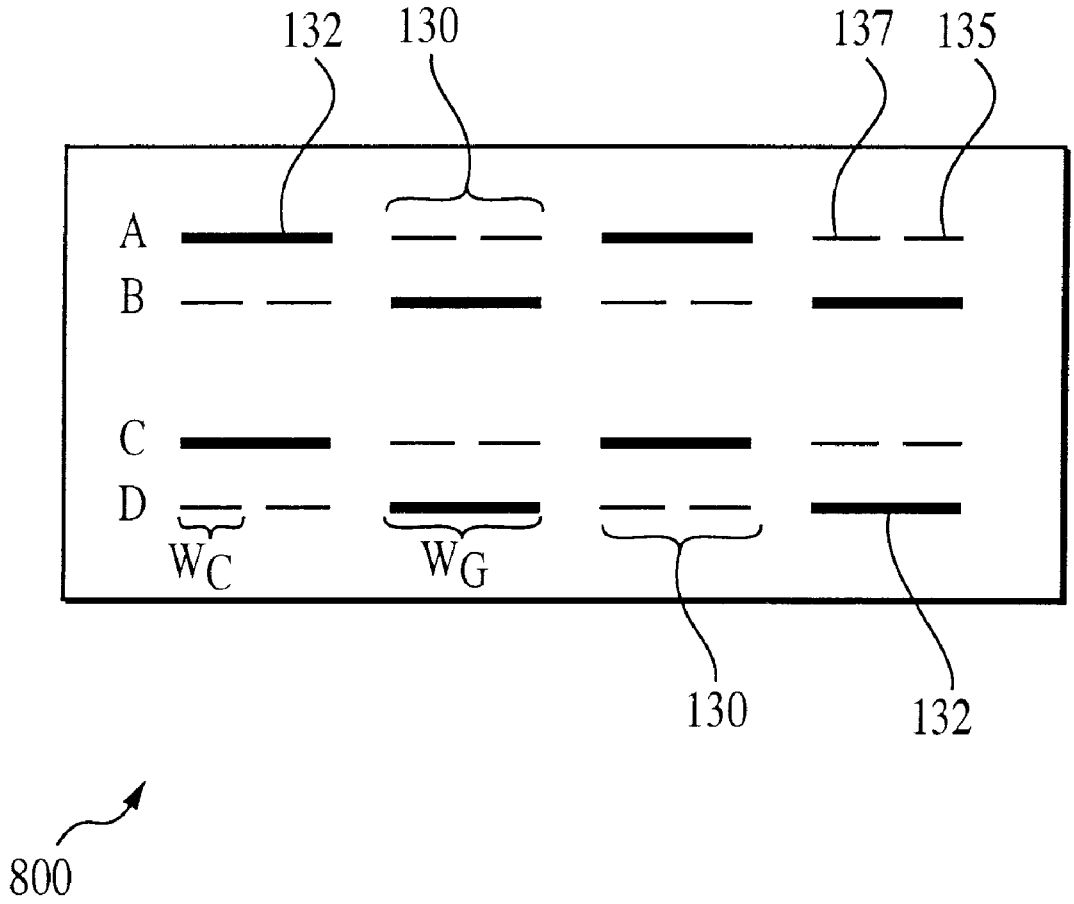
FIG. 8 is an illustration of a pattern of signal contact pairs and ground contacts positioned within a plug chicklet formed in accordance with an embodiment of the present invention.

FIG. 8 is an illustration of a pattern 800 of signal contact pairs 130 and ground contacts 132 positioned within the plug chicklet 100 formed in accordance with an embodiment of the present invention. As shown in FIGS. 3 and 8, the pattern 800 includes a row A of electrical elements 128 including a ground contact 132 next to a signal contact pair 130 next to a ground contact 132 next to a signal contact pair 130. Row B includes a signal contact pair 130 first, followed by a ground contact 132 second, followed by a signal contact pair 130 third, followed by another ground contact 132. The ground contacts 132 and the signal contact pairs 130 in the rows A and B are staggered thereby forming alternating columns of ground contacts 132 and signal contact pairs 130. Further, rows C and D are similarly staggered. Thus, a signal contact pair 130 is not horizontally or vertically directly adjacent to another signal contact pair 130.

The pattern, or configuration of ground contacts 132 in relation to signal contact pairs 130 and of ground pins 142 in relation to signal pins 140, as discussed above, reduces cross-talk between signal contact pairs 130 and also between signal pins 140 associated with signal contact pairs 130. The ground contacts 132 are positioned adjacent to signal contact pairs 130 thereby forming columns of alternating, in-line signal contact pairs 130 and ground contacts 132. That is, each signal contact pair 130 is positioned between two ground contacts 132. The ground contacts 132 act as shields between two signal contact pairs 130 positioned within a column, and thus, cross-talk between the in-column signal contact pairs 130 is diminished. Further, the ground contacts 132 act as shields between two signal contact pairs 130 positioned within a row, and thus, cross-talk between the in-row signal contact pairs 130 is diminished.

In one embodiment, each signal contact pair 130 within a plug chicklet 100 is positioned closer to a ground contact 132 than another signal contact pair 130. Consequently, each pair of signal pins 140 (associated with a signal contact pair 130) is positioned closer to a ground pin 142 than another pair of signal pins 140 (associated with another signal contact pair 130). Hence, each signal contact pair 130 is tightly coupled to an adjacent ground contact 132 and each pair of signal pins 140 (associated with a signal contact pair 130) is tightly coupled to an adjacent ground pin 142. The tight coupling of each signal contact pair 130 and pin 140 to a ground contact and pin 132 and 142, respectively, diminishes cross-talk between signal contact pairs 130 and also between pairs of signal pins 140 associated with signal contact pairs 130.

Figure 9:
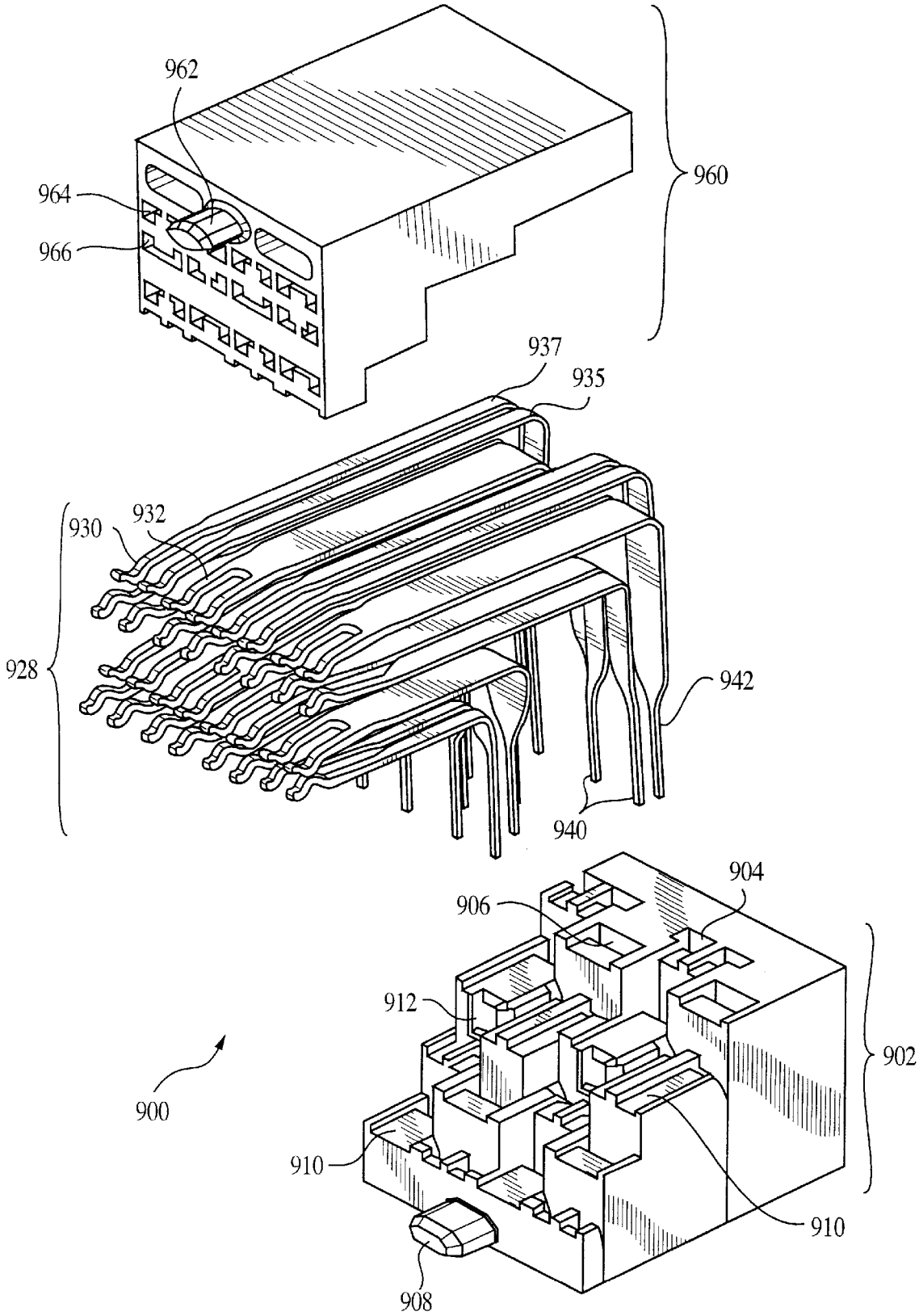
FIG. 9 is a front isometric exploded view of a header chicklet formed in accordance with an embodiment of the present invention.
Figure 10:
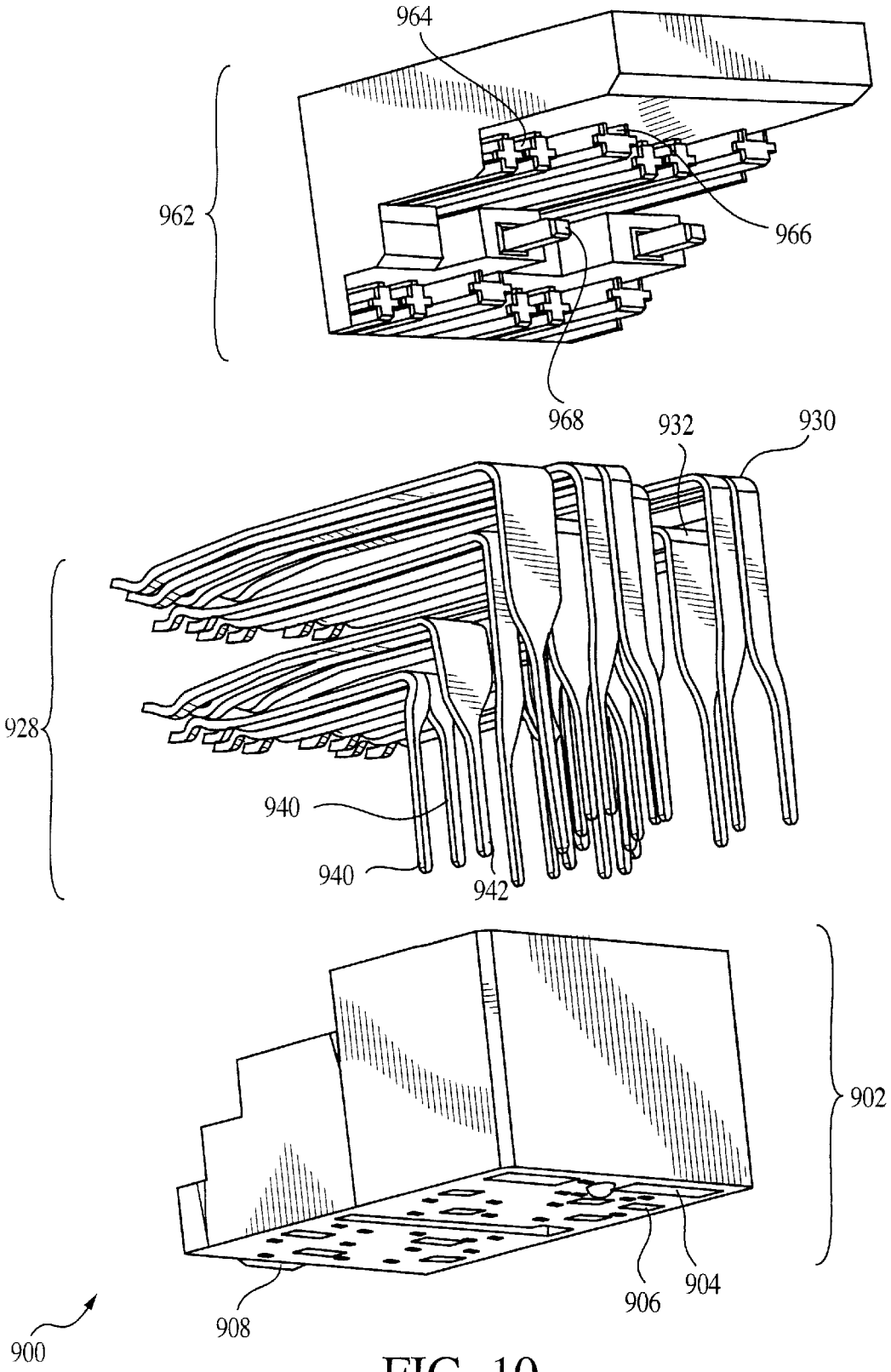
FIG. 10 is a rear isometric exploded view of a header chicklet formed in accordance with an embodiment of the present invention.

FIG. 9 is a front isometric exploded view of a header chicklet, or header terminal module 900 formed in accordance with an embodiment of the present invention. FIG. 10 is a rear isometric exploded view of the header chicklet 900 formed in accordance with an embodiment of the present invention. The header chicklet 900 includes a pin housing 902, electrical elements 928, and a contact housing 960. The pin housing 902 includes signal pin channels 904, ground pin channels 906, an alignment member 908, such as a latch or pin, aligning supports 910 and fastening receptacles 912, such as notches. The electrical elements 928 include a plurality of signal contact pairs 930 having signal contacts 935 and 937, a plurality of signal pins 940 connected to the signal contact pairs 930, a plurality of ground contacts 932 and a plurality of ground pins 942 connected to the ground contacts 932. The contact housing 960 includes an alignment member 962, such as a latch or pin, signal contact passages 964, ground contact passages 966 and fastening members 968, such as latches or pins.

Each signal contact 935 and 937 connects to a signal pin 940 and each ground contact 932 connects to a ground pin 942. Each signal contact 935, 937 and ground contact 932 is formed such that each signal contact 935, 937 and ground contact is bent into a right angle, as shown in FIG. 9. Alternatively, each signal contact 935 and 937 may be formed with, or joined to, its corresponding signal pin 940 through a right angle union, and each ground contact 932 may be formed with, or joined to, its corresponding ground pin 942 through a right angle union, thereby obviating the need to bend each signal contact 935, 937 and ground contact 932 into a right angle. That is, the signal contacts 935 and 937 are not coplanar with the signal pins 940. Similarly, ground contacts 932 are not coplanar with ground pins 942.

To assemble the header chicklet 900, the signal and ground pins 940 and 942 are positioned within the signal pin channels 904 and the ground pin channels 906, respectively. That is, the signal pin channels 904 and the ground pin channels 906 receive and retain the signal pins 940 and the ground pins 942, respectively. Once the signal and ground pins 940 and 942 are received and retained by the channels 904 and 906, the aligning supports 910 support and align the signal contact pairs 930 and the ground contacts 932. After the signal and ground pins 940 and 942 are positioned within the pin housing 902, the contact housing 960 is slid into position such that the signal contact pairs 930 and ground contacts 932 are received by the signal contact passages 964 and the ground contact passages 966. That is, the signal contact passages 964 and ground contact passages 966 receive and retain the signal contact pairs 930 and ground contacts 932, respectively. The contact housing 960 is slid toward the pin housing 902 until the fastening members 968 are received by the fastening receptacles 912. Preferably, the fastening members 968 snapably engage the fastening receptacles 912 thereby fastening the pin housing 902 to the contact housing 960. Thus, the electrical elements 928 are securely positioned within the pin housing 902 and the contact housing 960.

Figure 11:
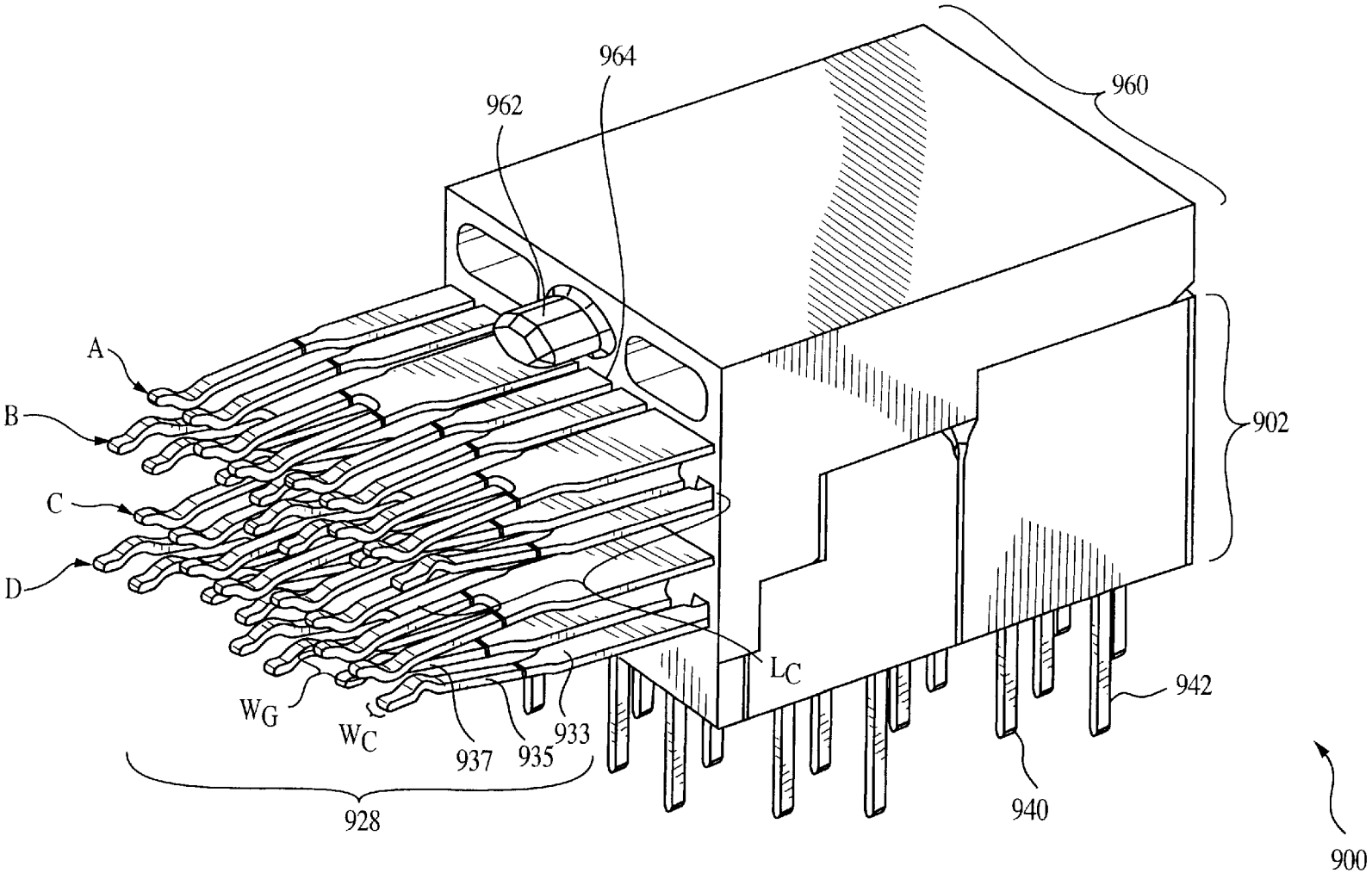
FIG. 11 is an isometric view of an assembled header chicklet formed in accordance with an embodiment of the present invention.

FIG. 11 is an isometric view of an assembled header chicklet 900 formed in accordance with an embodiment of the present invention. The signal contact pairs 930 each include two signal contacts 935 and 937 having spring beam body sections 933 arranged directly adjacent one another (The ground contacts 932 include similar spring beam body sections). The spring beam body sections 933 of a signal contact pair 930 have a length $L_C$ and a width $W_C$, and are aligned in a common plane. The electrical elements 928 of the header chicklet 900 are configured such that no signal contact pair 930 is horizontally or vertically directly adjacent to another signal contact pair 930. That is, two signal contact pairs 930 positioned within the same row are separated by a ground contact 932. Further, two signal contact pairs 930 positioned within the same column are separated by a ground contact 932. Each ground contact 932 has a width $W_G$, while each signal contact in a signal contact pair 930 has a width $W_C$. Each ground contact 932 is approximately the same width $W_G$ as a signal contact pair 930 ($2W_C$ plus the space between signal contacts in a signal contact pair 930).

Figure 12:
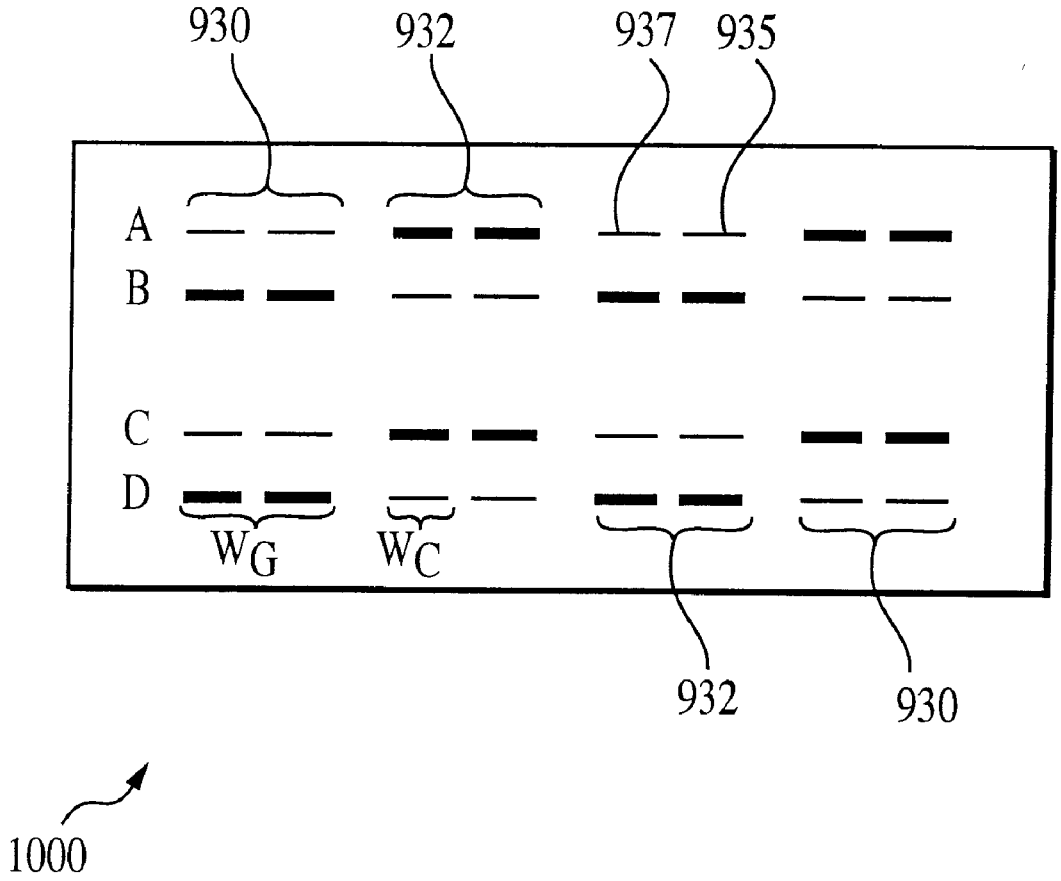
FIG. 12 is an illustration of a pattern of signal contact pairs and ground contacts positioned within a header chicklet formed in accordance with an embodiment of the present invention.

FIG. 12 is an illustration of a pattern 1000 of signal contact pairs 930 and ground contacts 932 positioned within the header chicklet 900 formed in accordance with an embodiment of the present invention. As shown in FIGS. 11 and 12, the pattern 1000 includes a row A of electrical elements 928 including a signal contact pair 930 next to a found contact 932 next to a signal contact pair 930 next to a ground contact 932. Row B includes a ground contact 932 first, followed by a signal contact pair 930 second, followed by a ground contact 932 third, followed by another signal contact pair 930. The ground contacts 932 and the signal contact pairs 930 in the rows A and B are staggered thereby forming alternating columns of ground contacts 932 and signal contact pairs 930. Further, rows C and D are similarly staggered. Thus, a signal contact pair 930 is not horizontally or vertically directly adjacent to another signal contact pair 930.

The pattern, or configuration of ground contacts 932 in relation to signal contact pairs 930 and of ground pins 942 in relation to signal pins 940, as discussed above with respect to FIGS. 11 and 12, reduces cross-talk between signal contact pairs 930 and also between pairs signal pins 940 associated with signal contact pairs 930. The ground contacts 932 are positioned adjacent to signal contact pairs 930 thereby forming columns of alternating, in-line signal contact pairs 930 and ground contacts 932. That is, each signal contact pair 930 is positioned between two ground contacts 932. The ground contacts 932 act as shields between two signal contact pairs 930 positioned within a column, and thus, cross-talk between the in-column signal contact pairs 930 is diminished. Further, the ground contacts 932 act as shields between two signal contact pairs 930 positioned within a row, and thus, cross-talk between the in-row signal contact pairs 930 is diminished.

In one embodiment, each signal contact pair 930 within a chicklet 900 is positioned closer to a ground contact 932 than another signal contact pair 930. Consequently, each pair of signal pins 940 (associated with a signal contact pair 930) is positioned closer to a ground pin 942 than another pair of signal pins 940 (associated with a signal contact pair 930). Hence, each signal contact pair 930 is tightly coupled to an adjacent ground contact 932 and each pair of signal pins 940 (associated with a signal contact pair 930) is tightly coupled to an adjacent ground pin 942. The tight coupling of each signal contact pair 930 and associated pair of signal pins 940 to a ground contact and pin 932 and 942, respectively, diminishes cross-talk between signal contact pairs 930 and pairs of signal pins 940 associated with signal contact pairs 930.

Figure 4:
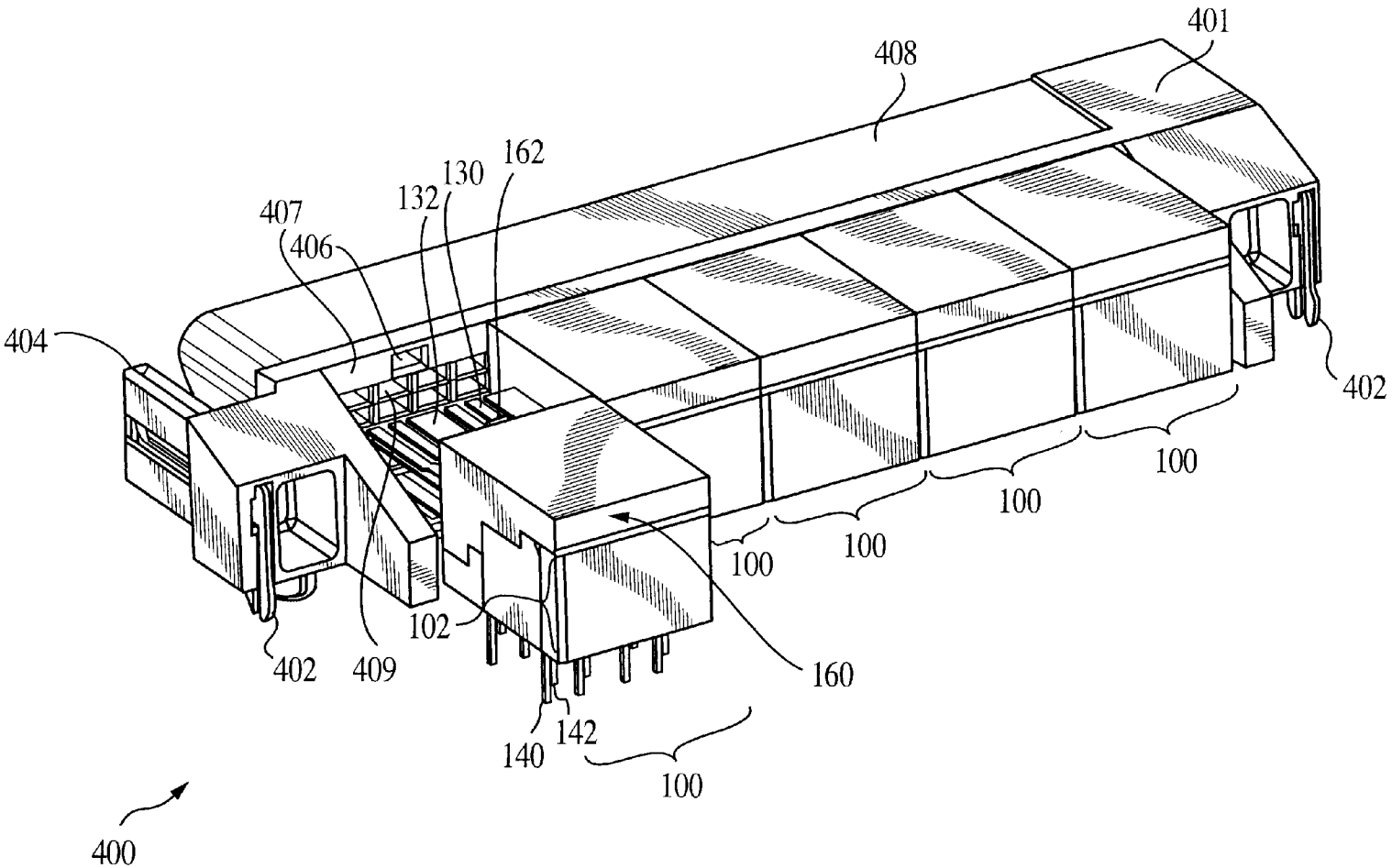
FIG. 4 is a rear isometric view of a plug assembly formed in accordance with an embodiment of the present invention.
Figure 5:
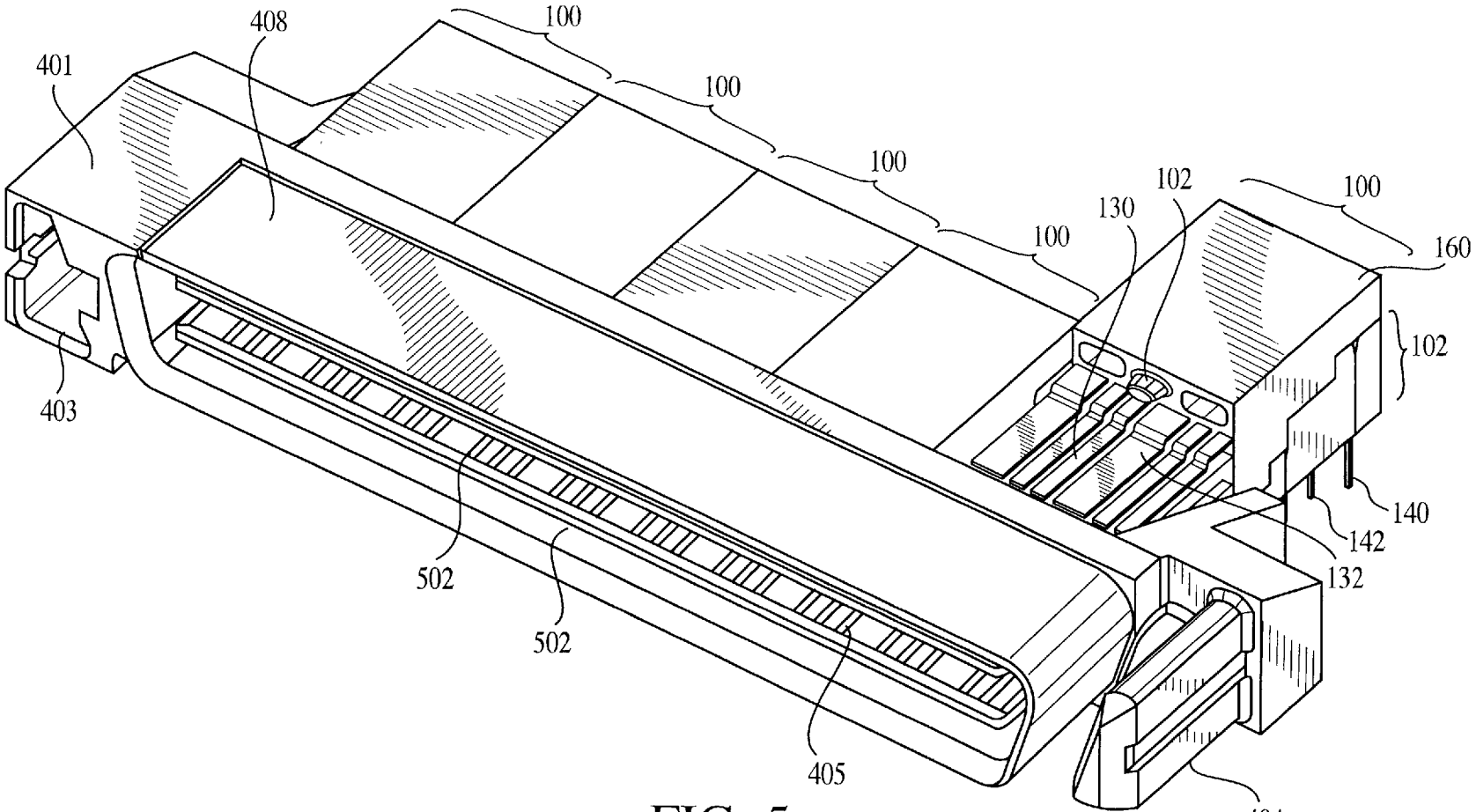
FIG. 5 is a front isometric view of a plug assembly formed in accordance with an embodiment of the present invention.

FIG. 4 is a rear isometric view of a plug assembly 400 formed in accordance with an embodiment of the present invention. FIG. 5 is a front isometric view of the plug assembly 400 formed in accordance with an embodiment of the present invention. The plug assembly 400 includes a plug housing 401, a plurality of plug chicklets 100, which are snapably positioned within chicklet ports 407, and an alignment shroud 408. The plug housing 401 includes ground board locks 402, a guide post 404, a guide slot 403, and the chicklet ports 407 having alignment receptacles 406 and contact passages 409. The alignment shroud 408 includes an interface cavity 405 having support members 502 to support and organize signal contact pairs 130 and ground contacts 132 within the cavity 405. The ground board locks 402 connect to a ground board (not shown). The plug housing 401 is formed integral with the alignment shroud 408.

Each chicklet 100 may be connected to the plug housing 401 through the chicklet ports 407. Each chicklet port 407 includes alignment receptacles 406 that correspond to the alignment members 108 and 162 located on the chicklets 100. As shown in FIG. 1, the alignment receptacles 406 receive and retain the alignment members 108 and 162 such that the alignment members 108 and 162 are snapably positioned within the alignment receptacles 406. As each chicklet 100 is positioned into a chicklet port 407, the signal contact pair 130 and ground contacts 132 pass through the contact passages 409 into the inner cavity 405 of the alignment shroud 408. The support members 502 within the inner cavity 405 support the signal contact pairs 130 and ground contacts 132. As each chicklet 100 is snapably positioned within a chicklet port 407, the signal contact pairs 130 and ground contacts 132 are supported and organized by the support members 502 within the inner cavity 405 of the alignment shroud 408. That is, a support member 502 supports a row of signal contact pairs 130 and ground contacts 132.

The signal contact pairs 130 and ground contacts 132 are exposed within the alignment shroud 408 such that the signal contact pairs 130 and ground contacts 132 may contact, or interface with, signal contact pairs 930 and ground contacts 932 positioned within a header assembly (not shown). That is, when the plug assembly 400 is mated with a header assembly, the lengths $L_C$ of signal contact spring beams 935 and 937 positioned within the header assembly may overlap the lengths $L_C$ of counterpart signal contact blades 135 and 137 positioned within the plug assembly 400. Optionally, the lengths $L_C$ of signal contact blades 135 and 137 positioned within the plug assembly 400 may overlap the lengths $L_C$ of the signal contact spring beams 935 and 937 of the plug assembly 400. Alternatively, the interface, or contact of signal contact blades 135 and 137 positioned within the plug assembly 400 and the signal contact spring beams 935 and 937 positioned within the header assembly 600 may occur over a portion less than the entire lengths $L_C$ of the signal contact blades 135 and 137 of the plug assembly 400 and lengths $L_C$ of the signal spring beams 935 and 937 of the header assembly.

Figure 6:
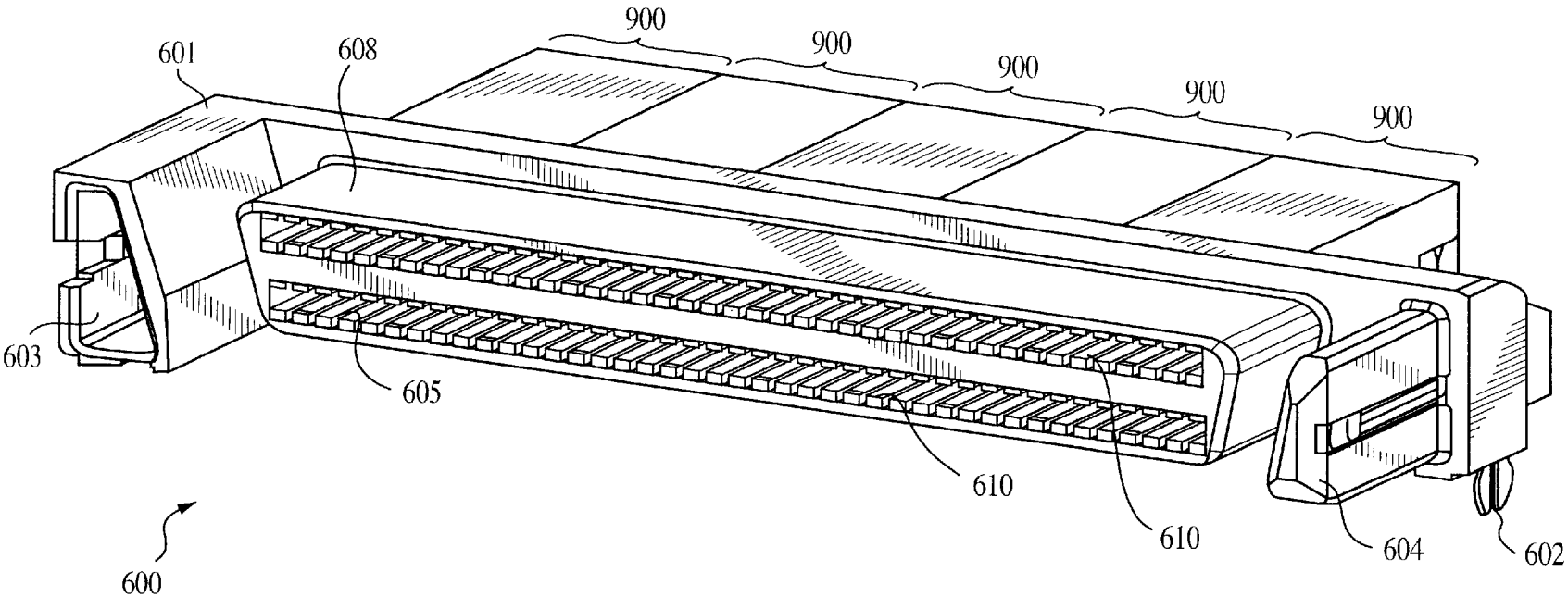
FIG. 6 is a front isometric view of a header assembly formed in accordance with an embodiment of the present invention.

FIG. 6 is a front isometric view of a header, or receptacle assembly 600 formed in accordance with an embodiment of the present invention. The header assembly 600 includes a header housing 601, a plurality of header chicklets 900 snapably positioned within chicklet ports (not shown) similar to chicklet ports 407, and an alignment shroud 608. The header housing 601 includes ground board locks 602, a guide post 604, a guide slot 603, and the chicklet ports having alignment receptacles (not shown) and contact passages (not shown), resembling the receptacles 406 and 409 of FIG. 4. The alignment shroud 608 includes an inner cavity 605 having support members 610 to support and organize the signal and ground contacts 130 and 132 within the inner cavity 605. The ground board locks 602 connect to a ground board (not shown). The header housing 601 is formed integral with the alignment shroud 608.

The header chicklets 900 are connected to the header housing 601 similar to how the plug chicklets 100 are connected to the plug housing 401 as discussed above with respect to FIGS. 4 and 5. The alignment shroud 608 of the header assembly 600 may be larger than the alignment shroud 408 of the plug assembly 400, in order to receive, or mate with, the alignment shroud 408 of the plug assembly 400. The alignment shroud 608 of the header assembly 600 receives, or mates with the alignment shroud 408 of the plug assembly 400 such that signal contact pairs 930 within the inner cavity 605 of the header assembly 600 contact signal contact pairs 130 within the inner cavity 405 of the plug assembly 400. Further, when the header assembly 600 and the plug assembly 400 are mated, the ground contacts 932 within the inner cavity 605 of the header assembly 600 contact, or interface with, ground contacts 132 within the inner cavity of the plug assembly 400. As shown with respect to FIGS. 9–11, each second, or header chicklet 900 includes electrical elements 928 having spring beams. The electrical elements 928 included within the chicklets 900 of the header assembly 600 deflect when mated with the electrical elements 128 of the chicklets 100 of the plug assembly 400. Referring to FIGS. 8 and 12, Row A of the pattern 1000 of a header chicklet 900 deflects upward such that Row A of a header chicklet 900 contacts the top of Row A of the pattern 800 of a plug chicklet 100. Row B of the pattern 1000 of a header chicklet 900 deflects downward such that Row A of the pattern 800 of a plug chicklet 100 contacts the top of Row B of a header chicklet 900. Similarly, Row C of a header chicklet 900 deflects upward over Row C of the plug chicklet 100, while Row D of the header chicklet deflects downward under Row D of the plug chicklet 100. Alternatively, the direction of deflection for each row of the pattern 1000 may be reversed. For example, Row A of a header chicklet 900 may deflect downward and contact the bottom of Row A of a chicklet 100.

Figure 7:
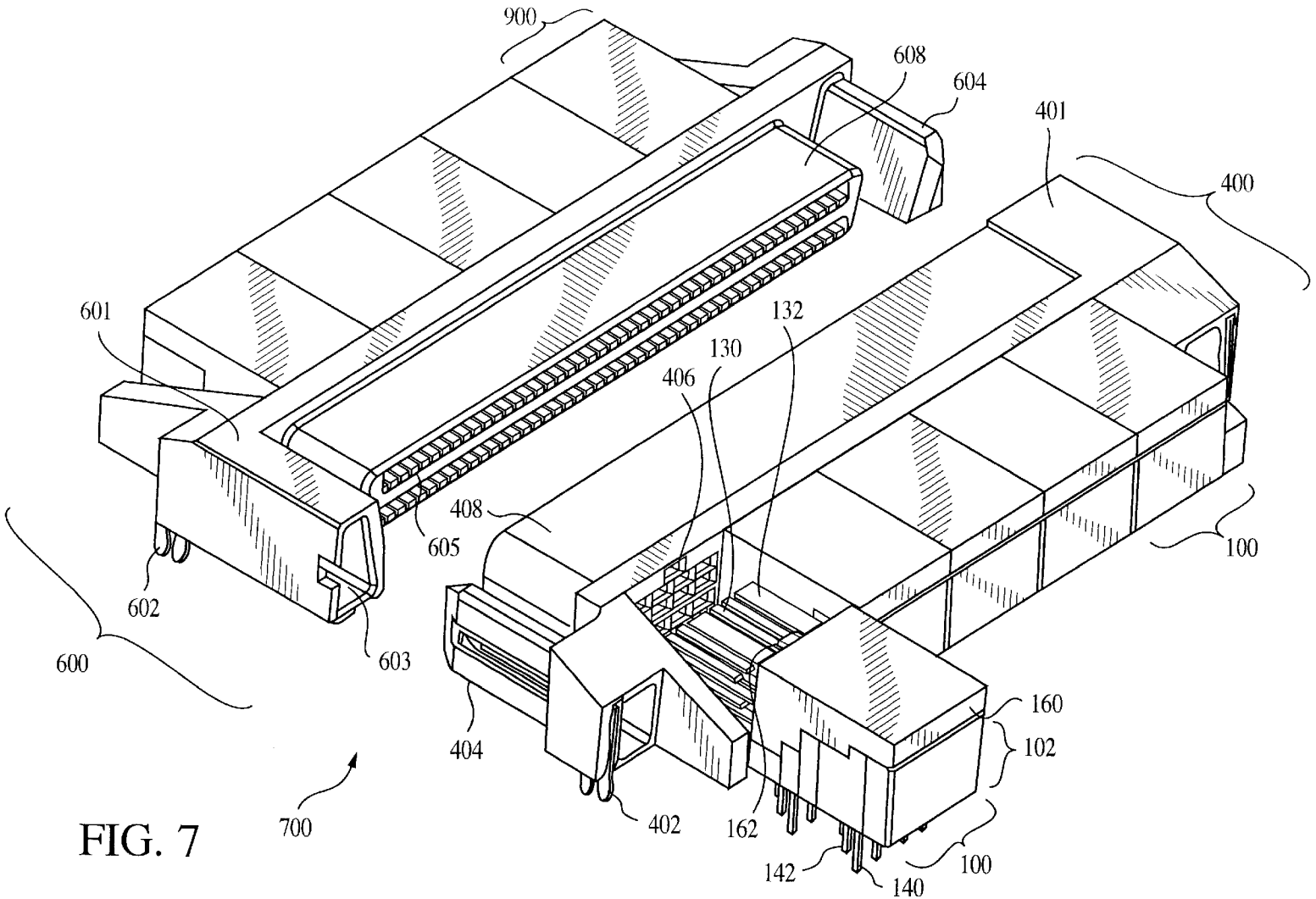
FIG. 7 is an isometric view of a docking connector formed in accordance with an embodiment of the present invention.

FIG. 7 is an isometric view of a docking connector 700 formed in accordance with an embodiment of the present invention. The docking connector 700 includes the plug assembly 400 and the header assembly 600. FIG. 7 shows the docking connector 700 just prior to the mating of the header assembly 600 and the plug assembly 400. When mated, the guide slot 403 of the plug assembly 400 receives the guide post 604 of the header assembly 600, while the guide slot 603 of the header assembly 600 simultaneously receives the guide post 404 of the plug assembly 400. The exposed signal contact blades 135 and 137 of signal contact pairs 130 positioned within the plug assembly 400 contact the counterpart exposed signal contact blades 935 and 937 of signal contact pairs 930 positioned within the header assembly 600. That is, as described above with respect to FIG. 4, when mated, signal contact blades 135 and 137 positioned within the plug assembly 400 overlap deflected signal spring beams 935 and 937 positioned within the header assembly 600. The exposed signal and ground pins 140 and 142 of the plug assembly 400 and the exposed signal and ground pins 940 and 942 of the header assembly 600 connect to circuit boards (not shown). That is, the signal and ground pins 140 and 142 of the plug assembly 400 are positioned within receptacles (not shown) of a first circuit board (not shown), while the signal and ground pins 940 and 942 of the header assembly 600 are positioned within receptacles (not shown) of a second circuit board (not shown).

Thus, electrical signals may travel from the first circuit board to the second circuit board. The electrical signals may travel from the first circuit board, through a signal pin 140 of a plug chicklet 100 positioned on the plug assembly 400. The electrical signals may then travel from a signal pin 140 of the plug chicklet 100 to an associated signal contact 135 or 137. The electrical signals then travel from the signal contact 135 or 137 to a signal contact 935 or 937 of a header chicklet 900 positioned within the header assembly 600. The signal contact 135 or 137 of the plug assembly 400 contacts, or interfaces with, the counterpart signal contact 935 or 937 of the header assembly 600 through the mating of the plug assembly 400 with the header assembly 600. The electrical signals travel through this contact, or interface, between the signal contact 135 or 137 of the plug assembly 400 and the signal contact 935 or 937 of the header assembly 600. The electrical signals then travel from the signal contact 935 or 937 of a header chicklet 900 positioned within the header assembly 600 to the signal pin 940 that corresponds to that signal contact 935 or 937. The electrical signals then travel from the signal pin 940 to the second circuit board. In this way, electrical signals may travel from the first circuit board to the second circuit board, or vice versa.

The ground boards, or planes (not shown), to which the assemblies 400 and 600 mount, reduce the amount of cross-talk and electrical interference within the docking connector 700. Similar to the ground contacts and pins 132, 142, 932 and 942, the ground boards act as signal shields. Because cross-talk and electrical interference is controlled by the ground contacts 132, the ground pins 142 and the ground boards, signal speeds within the docking connector 700 are increased.

Further, the chicklets 100 and 900 allow for interchangeable plug and header assemblies 400 and 600. That is, each plug assembly 400 and header assembly 600 may be manufactured with component parts that may be interchanged or replaced easily. Instead of securing a number of electrical elements 128 and 928 into the plug and header assemblies 400 and 600, respectively, smaller numbers of electrical elements 128 and 928 may be positioned into the assemblies 400 and 600, respectively. That is, instead of positioning one, all-encompassing chicklet having all the electrical elements 128 into, e.g., a plug assembly 400, smaller interchangeable chicklets 100 may be used. Thus, when some electrical elements 128 of the plug assembly 400 falter, only the chicklet 100 including the faltering electrical elements 128 needs to be replaced. Further, when some electrical elements 928 of the header assembly 600 falter, only the chicklet 900 including the faltering electrical elements 928 needs to be replaced.

Thus, embodiments of the present invention provide a docking connector that minimizes electrical interference and cross-talk among signal contacts due to the shielding of the ground contacts. Further, embodiments of the present invention provide a docking connector that may accommodate increased signal speeds due to the minimization of cross-talk and electrical interference between signal contacts. Also, embodiments of the present invention provide a docking connector having electrical elements that may be easily and efficiently replaced due to the interchangeability and modularity of the terminal modules, or chicklets.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications that incorporate those features coming within the scope of the invention.

What is claimed is:

1. A connector system including a plurality of interchangeable terminal modules, each of said interchangeable terminal modules comprising:

a terminal module housing;

a plurality of signal contact pairs held in said terminal module housing and arranged in rows and columns, each of said signal contact pairs having first and second signal contacts arranged directly adjacent one another; and a plurality of ground contacts held in said terminal module housing, arranged in said rows and columns, and interspersed between adjacent signal contact pairs, said ground contacts and signal contact pairs being arranged in a staggered pattern with a ground contact positioned between adjacent signal contact pairs in at least one row, and with said ground contact positioned between adjacent signal contact pairs in at least one column.

2. The system of claim 1, wherein signal contact pairs in a first row of said pattern in each of said interchangeable terminal modules are staggered relative to signal contact pairs in a second row of said pattern in said each of said interchangeable terminal modules.

3. The system of claim 1 wherein said terminal module housing includes:

a pin housing for receiving and retaining said signal and ground pins connected to said signal contact pairs and said ground contacts, respectively; and a contact housing for receiving and retaining said signal contact pairs and said ground contacts, said pin housing and said contact housing being snapably positioned to one another.

4. The system of claim 1 further comprising a plug assembly having a plurality of terminal module ports, wherein said interchangeable terminal modules constitute plug terminal modules that are positioned within corresponding terminal module ports.

5. The system of claim 1 further comprising a header assembly having a plurality of terminal module ports, wherein said interchangeable terminal modules constitute header terminal modules that are positioned within corresponding terminal module ports.

6. The system of claim 1 further comprising:

a plug assembly having a first terminal module port, wherein a first interchangeable terminal module is positioned within said first terminal module port; and a header assembly having a second terminal module port, wherein a second interchangeable terminal module is positioned within said second terminal module port, said plug assembly and said header assembly mating such that a signal contact pair of said first interchangeable terminal module contacts a signal contact pair of said second interchangeable terminal module.

7. The system of claim 6 further comprising:

a first circuit board connected to said plug assembly; and a second ground board connected to said header assembly.

8. The system of claim 1, wherein said first and second signal contacts and said ground contacts arranged in each row have planar body sections arranged in a common plane.

9. The system of claim 1, wherein each of said ground contacts has a width that substantially equals a width of a corresponding signal contact pair and a spacing between said first and second signal contacts in said corresponding signal contact pair.

10. The system of claim 1, wherein a single planar ground contact is interspersed between any two adjacent signal contact pairs in said rows and said columns.

11. A docking connector system including:

a plurality of interchangeable plug and header chicklets, each of said interchangeable plug and header chicklets comprising:

a chicklet housing;

a plurality of signal contact pairs held in said chicklet housing and arranged in pairs of rows and in columns, each of said signal contact pairs having first and second signal contacts arranged directly adjacent one another; and a plurality of ground contacts held in said chicklet housing and arranged in said pairs of rows and in said columns, said ground contacts and said signal contact pairs being arranged in a staggered pattern with ground contacts positioned between each signal contact pair in said rows and columns, a plug assembly having a first chicklet port, wherein an interchangeable plug chicklet is positioned within said first chicklet port; and a header assembly having a second chicklet port, wherein an interchangeable header chicklet is positioned within said second chicklet port, said plug assembly and said header assembly mating such that a signal contact pair of said interchangeable plug chicklet contacts a signal contact pair of said interchangeable header chicklet.

12. The system of claim 11, wherein signal contact pairs in a first row of said pattern in each of said interchangeable terminal modules are staggered relative to signal contact pairs in a second row of said pattern in said each of said interchangeable terminal modules.

13. The system of claim 11 wherein said chicklet housing includes:

a pin housing for receiving and retaining said signal and ground pins; and a contact housing for receiving and retaining said signal contact pairs and said ground contacts, said pin housing and said contact housing being snapably positioned to one another.

14. The system of claim 11 further comprising:

a first circuit board connected to said plug assembly; and a second ground board connected to said header assembly.

15. The system of claim 11, wherein said first and second signal contacts and said ground contacts arranged in each row have planar body sections arranged in a common plane.

16. The system of claim 11, wherein each of said ground contacts has a width that substantially equals a width of a corresponding signal contact pair and a spacing between said first and second signal contacts in said corresponding signal contact pair.

17. The system of claim 11, wherein a single planar ground contact is interspersed between any two adjacent signal contact pairs in said rows and said columns.

18. A connector system comprising:

a plug assembly and a header assembly, each of said plug assembly and said header assembly including:

a plurality of signal contact pairs arranged in first and second rows, each of said signal contact pairs having first and second signal contacts arranged directly adjacent one another; and a plurality of ground contacts arranged in said first and second rows, said ground contacts and said signal contact pairs being arranged in a staggered pattern in which ground contacts in said first row are positioned between adjacent signal contact pairs in said first row, and are positioned between adjacent signal contact pairs in said second row.

19. The system of claim 18 further including interchangeable plug and header chicklets, wherein each of said plug and header chicklets comprises:

a pin housing for receiving and retaining signal and ground pins; and a contact housing for receiving and retaining signal contact pairs and ground contacts, said pin housing and said contact housing being snapably positioned to one another.

20. The system of claim 18 wherein signal contact pairs in said first row of said staggered pattern in each of said interchangeable terminal modules are offset relative to signal contact pairs in said second row of said staggered pattern in said each of said interchangeable terminal modules.

21. The system of claim 18, wherein said first and second signal contacts and said ground contacts arranged in each row have planar body sections arranged in a common plane.

22. The system of claim 18, wherein each of said ground contacts has a width that substantially equals a width of a corresponding signal contact pair and a spacing between said first and second signal contacts in said corresponding signal contact pair.

23. The system of claim 18, wherein a single planar ground contact is interspersed between any two adjacent signal contact pairs in said rows and said columns.

* * * * *